US006742909B2

(12) United States Patent
Conti et al.

(10) Patent No.: US 6,742,909 B2
(45) Date of Patent: Jun. 1, 2004

(54) LIGHTED LINE

(75) Inventors: Ronald S. Conti, Clairton, PA (US); Linda L. Chasko, Clairton, PA (US)

(73) Assignee: The United States of America as represented by the Secretary of the Department of Health and Human Services, Washington, DC (US)

( * ) Notice: Subject to any disclaimer, the term of this patent is extended or adjusted under 35 U.S.C. 154(b) by 0 days.

(21) Appl. No.: 10/086,773

(22) Filed: Feb. 28, 2002

(65) Prior Publication Data

US 2002/0126473 A1 Sep. 12, 2002

Related U.S. Application Data

(60) Provisional application No. 60/274,102, filed on Mar. 7, 2001.

(51) Int. Cl.[7] ..... F21V 9/16
(52) U.S. Cl. ..... 362/84; 362/108
(58) Field of Search ..... 362/84, 108, 154, 362/320, 391, 341; 248/925; 182/133

(56) References Cited

U.S. PATENT DOCUMENTS

| | | | | |
|---|---|---|---|---|
| 2,722,696 A | | 11/1955 | Johnson | |
| 4,836,815 A | | 6/1989 | Spurgeon | 362/202 |
| 5,245,516 A | * | 9/1993 | de Haas et al. | 362/84 |
| 5,341,896 A | * | 8/1994 | Amacker | 182/133 |
| 5,383,100 A | * | 1/1995 | Kikos | 362/84 |
| 5,485,355 A | | 1/1996 | Voskoboinik et al. | 362/84 |
| 5,570,945 A | * | 11/1996 | Chien et al. | 362/84 |
| 5,946,071 A | | 8/1999 | Feldman | 351/158 |
| 5,951,140 A | | 9/1999 | Feldman | 362/84 |
| 6,082,867 A | * | 7/2000 | Chien | 362/84 |
| 6,085,698 A | * | 7/2000 | Klein | 362/84 |

OTHER PUBLICATIONS

Conti et al., "Technologies for Today's Mine Emergency Responders," 7th Annual Conference of The International Emergency Management Society, TIEMS 2000, pp. 105–121, May 16–19, 2000, Orlando, Florida.

* cited by examiner

*Primary Examiner*—Y. My Quach-Lee
*Assistant Examiner*—Peggy A. Neils
(74) *Attorney, Agent, or Firm*—Klarquist Sparkman LLP

(57) ABSTRACT

A lighted line having an elongate flexible wire-formed bulbless light source is encased in a supportive covering which may include a surrounding rope and tubular sheathing. An electrical power source operatively connected to the wire-formed light source is adapted to energize it to produce light which radiates laterally of the line and emanates through the rope and tubular sheathing.

33 Claims, 1 Drawing Sheet

FIG. 1
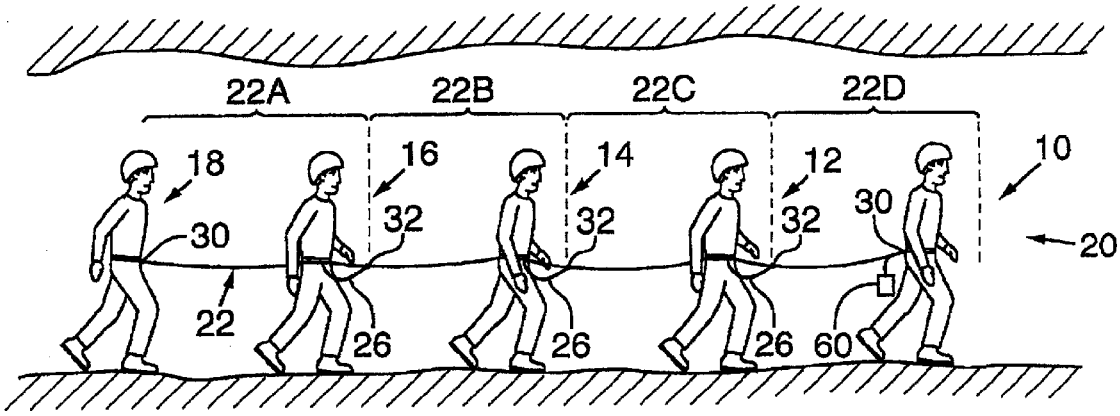
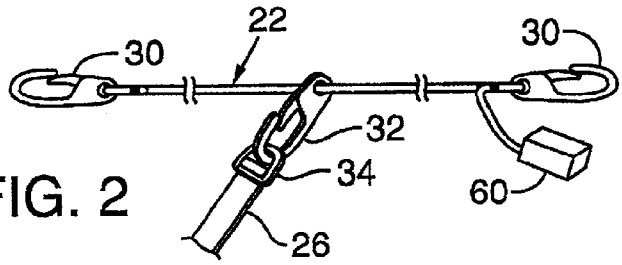
FIG. 2
FIG. 3
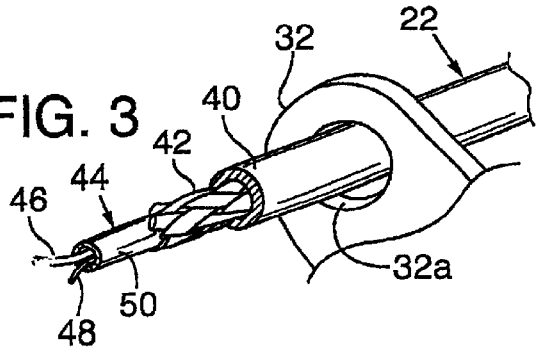
FIG. 4
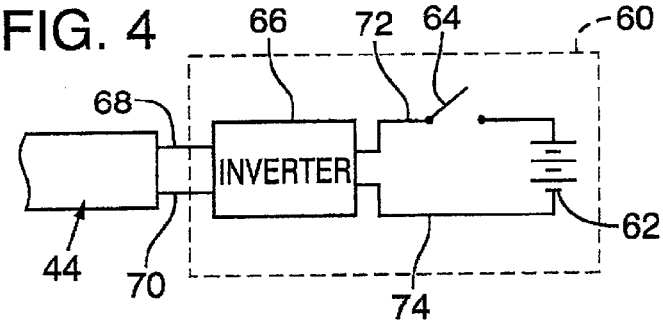

LIGHTED LINE

PRIORITY CLAIM

This application the benefit of U.S. Provisional Patent Application No. 60/274,102, filed Mar. 7, 2001.

FIELD OF THE INVENTION

The present invention relates to a lighted line, and more particularly to a lighted line which has sufficient strength and durability that it may be used in place of a working rope.

BACKGROUND OF THE INVENTION

There are many instances where it would be desirable to have an elongate flexible line which is self-lighted, yet which has the strength and durability found in a normal working rope.

Specific applications include use as a lifeline for interconnecting people in environments where visibility may be impaired. Examples of such are darkened tunnels, or smoke-filled buildings. In such instances multiple parties may be attached to a single line at spaced intervals therealong. In the past, where non-lighted lines have been used, they have been subject to tripping hazards, entangling on obstacles, and other problems which cause difficult or dangerous situations for the users.

Further, lighted lines having sufficient strength and durability also could be used for other activities, such as for tethering or supporting in dark or impaired visibility regions, for entertainment value, such as might be used in jump ropes, and many other applications.

SUMMARY OF THE DISCLOSURE

An object of the present invention is to provide a novel self-lighted, strong and durable elongate flexible line which may be used in applications where a usual rope may have been used in the past.

A further object of the invention is the provision of an elongate self-lighted line which may be segmented by different light characteristics, such as colorations, along the length of the line to denote specific positional arrangements.

Another object of the invention is the provision of a lighted line which requires only small power requirements, such that it is adaptable for use in environments where the use of lighted lines requiring higher electrical power requirements would be unsafe or could produce hazards.

A still further object of the present invention is to provide an elongate flexible line which produces light radiating outwardly generally from all sides of the line, such that it is visible from any direction.

Yet another object of the present invention is to provide a novel lighted lifeline which may be used in darkened or otherwise impaired visibility environments for interconnecting multiple parties in an activity such that the lifeline is visible to alleviate tripping and falling problems and to allow personnel working in such environments, or around moving machinery in low light areas, to be seen more easily.

These and other objects and advantages of the present invention will become more fully apparent upon reading of the following description in light of the following drawings.

BRIEF DESCRIPTION OF THE DRAWINGS

FIG. 1 is a general view of a number of parties interconnected to each other in what could be a darkened, smoky, or other impaired visibility environment, using a lighted line according to the present invention;

FIG. 2 is an enlarged view of the lighted line with attachments as it might be used in the illustration of FIG. 1.;

FIG. 3 is an enlarged perspective view of a section of the lighted line with portions broken away to illustrate component parts of the line; and FIG. 4 is an electrical circuit diagram illustrating schematically means for powering the lighted line.

DETAILED DESCRIPTION

Referring to FIG. 1, a plurality of rescue, or other working team members 10, 12, 14, 16, 18 are illustrated in a potentially impaired visibility environment, such as a mining tunnel 20. The members of the team are operatively connected to an elongate connecting line 22. The lead and tail members of the team 10 and 18, respectively, are connected generally directly to line 22, while members 12, 14, and 16 are connected to line 22 via auxiliary lines, or straps, 26. As is best seen in FIG. 2, line 22 has double locking snap connectors 30 secured to its opposite ends, to which team members 10 and 18 may be connected in a usual fashion. Other double locking snap connectors, such as that indicated generally at 32, are mounted for sliding along line 22 by having line 22 extending through an eye 32*a* as illustrated in FIG. 3. Carabiners or other styles of connectors indicated generally at 34 in FIG. 2 interconnect straps, or auxiliary lines, 26 to connectors 32. The opposite sets of ends of lines 26 are operatively connected to individual team members in a usual fashion. Swivel connectors (not shown) also may be used in connecting team members to the line. For example swivels could be connected between connectors 30 and line 22, and between connectors 32 and lines 26.

In this working arrangement as indicated in FIG. 1, connectors 30 at opposite ends of line 32 are connected to the lead and tail team members, while intermediate members 12, 14, and 16, although generally positioned at spaced intervals along line 22, are allowed to move longitudinally along the line due to connectors 32 being slidable along line 22.

It has been found that when using the usual rope or line, it is difficult for team members to maintain their position in relation to the line, they may get entangled in the line, or trip over such and fall which may cause other team members to fall, or the line may get entangled in other obstacles which presents its own set of problems Further, if there is equipment working in the region and the environment is dark, smoky, or visibility is impaired for some other reason, it is difficult for others to see the workers and their line, again presenting safety hazards.

In an effort to overcome these and other problems the present device uses a self-lighted line for line 22.

Explaining further, and referring to FIG. 3, a section of line 22 is shown on an enlarged scale. The line includes an elongate translucent plastic outer tube or sheathing 40. Extending longitudinally through the center of tube 40 is an elongate braided rope 42, also referred to herein as a tension-resisting member. The rope 42 is so constructed that light may pass therethrough also. In the illustrated embodiment the rope has openings extending between braided strands through which light may pass. Further, the strands of material in the braided rope maybe of a material which allows light to pass therethrough.

Extending longitudinally through the center of rope 42 is an elongate flexible, bulbless, light wire 44. In the illustrated embodiment the light wire may be a wire-formed electroluminescent light source in the form of an elongate flexible cable which incorporates a pair of electrodes 46, 48 typically made of copper wire. These wires are encased in a surrounding supporting sheath 50 which may be a plastic covering. An electroluminescent material (not shown) is interposed between electrodes 46, 48. The electroluminescent material may typically comprise an electroluminophor powder disposed in a resin. Sheath 50 is made of a flexible translucent material through which light may pass also. The resulting elongated light wire 44 is compact, flexible, and is easily extended through the center of braided rope 42. As is known in the art, the color, or possibly other differentiation characteristics, of the light which may be emitted by the electroluminescent light source, or line, 44 is generally dependent upon the type of electroluminophor powder selected or may be varied by the characteristics of sheath 50.

The flexible elongate light source, or light wire, 44 may be of the type disclosed in U.S. Pat. No. 5,485,355 entitled "Electroluminescent Light Sources." A source of light wire in the United States which has been found to work well is Live Wire Enterprises at P.O. Box 670081, Flushing, N.Y. 11367.

A battery pack 60 is shown in FIG. 2 connected to line 22 as an electrical source for operating light source, or wire, 44. As shown in greater detail in FIG. 4, the battery pack 60 includes a battery 62, a switch 64, and an inverter 66. Terminals 68, 70 are operatively connected to electrodes 46, 48. Light source, or wire, 44 includes a pair of terminals 68, 70 which are connected to inverter 66. The inverter 66 also includes input lines 72, 74. Input line 74 is connected directly to one side of battery 62, while line 72 is connected to one side of switch 64. Closing of switch 64 operatively connects battery 62 to inverter 66 which provides alternating current to the light source, or wire, 44. When the switch is open, as shown in FIG. 4, no current flows to light source 44, and thus no light is produced thereby. When switch 64 is closed current is provided to light source 44 and it is in a luminescent condition to produce light.

The light source, or wire, 44 produces substantially continuous laterally radiating light along a light emitting path, or region, which is coextensive with the length of light source 44. In the illustrated embodiment, the full length of line 22 would be lit by light source 44 extending longitudinally therealong. Since sheath 50, rope 42, and tubing 40 all permit light to pass therethrough, light emanating from light source 44 will be visible radiating laterally along the length of the line.

In selected operations, it may be desirable to have different longitudinal sections of a line show in different colors, or have other different light characteristics. Thus, as illustrated in FIG. 1, each one quarter length of line 22A, 22B, 22C, 22D, may be colored differently from other quarters of the line. For example, one quarter length of the line may be blue, the next quarter length orange, the next quarter length green, and the final quarter length red. This is accomplished by using lines with different color characteristics connected in series along line 22.

As is known in the art, the color of the light emitted by an electroluminescent source depends on the type of electroluminophor powder used and/or the characteristics of sheath 50, and thus lines of different colors may be provided to be connected in series to produce sections of different color along the line.

A specific embodiment of the invention which has been found to work well to provide a lighted team lifeline 22 as shown in FIGS. 1-3 includes four different colored flexible light wires 44 (from Live Wire Enterprises as noted previously) connected in series and passing longitudinally through a 0.6 cm diameter hollow single braided polypropylene rope 42 (336 kg tensile strength). The light wire has four sections, each of which is approximately two meters in length, and each in a different color, such as blue, orange, green, and red, respectively from one end to the other end. The entire length of the braided rope is sheathed with a clear polyvinyl chloride tubing 40. This line structure has double locking snap connectors, such as that indicated at 30, connected thereto by having the opposite end portions of line 22 doubled back and bound.

Battery pack 60 is connected to one end of the line as indicated schematically in FIGS. 2 and 4. Battery 62 may be a 9 volt battery which will power the light source throughout the full length of the line. The three movable double locking snap connectors 32 are slidably mounted on the line intermediate connectors 30 allowing intermediate team members to move freely along the line to provide flexibility of motion to perform activities needed. When the switch 64 is closed, power from battery 62 causes line 22 to light. The multiple line segments of different colors permit the team members to visualize a normal work spacing along the line, but they can move as needed along the length of the line.

Although the lighted line has been discussed in detail above as being used as a lighted line to which personnel may be attached, the line may also serve other purposes. Since the line has good tensile strength due to the use of the braided rope 42 and good durability due to the enclosing tube sheathing 40 it allows the line to be used in many other applications. Such other applications where a normal rope would be used, but where a lighted line is beneficial are use as support lines, tethers, leashes, such as may be used for controlling animals in nighttime conditions, jump ropes, or for other entertainment purposes.

The product is strong, durable, and versatile to provide a wide variety of uses where a lighted line may be desirable.

While a preferred embodiment of the present invention has been described in detail above, various modifications, alterations, and changes may be made without departing from the spirit and scope of the invention as is defined in the following claims.

What is claimed is:

1. A lighted line comprising an elongate flexible wire-formed light source capable of generating laterally radiating light having an elongate flexible translucent sheathing extending thereabout, an electrical power source operatively connected to said light source adapted to energize said light source, and an elongate flexible covering extending about said light source, said covering comprising an elongate rope having an axially extending opening through which said light source extends axially and constructed to permit light radiating from said light source to pass therethrough.

2. The line of claim 1, wherein said rope comprises a braided rope.

3. The line of claim 1, wherein said covering further comprises an elongate flexible translucent tube having a central bore through which said rope and light source extend.

4. The line of claim 1, wherein said light source comprises an electroluminescent light source and said electrical power source comprises a battery electrically connected through an inverter to said light source to provide alternating current to said light source.

5. The line of claim 1, wherein said rope comprises an elongate flexible braided rope having light passages extending between braided strands in the rope to permit light to pass therethrough.

6. The line of claim 1, wherein the light source comprises multiple elongate light source segments coupled together in end-to-end configuration with each light source segment having a visual characteristic different from the segment adjacent thereto.

7. The line of claim 6, wherein said visual characteristic is color.

8. The line of claim 6, wherein the light source segments comprise electroluminescent light source segments which are electrically connected in series to be energized by a single power source.

9. The line of claim 1, which further comprises a first connector coupled to one end of the line and a second connector coupled to the other end of the line.

10. The line of claim 9, which further comprises a third connector mounted on said line for sliding movement along the line intermediate the first and second connectors.

11. The line of claim 9, wherein a connector comprises a snap lock connector adapted to permit connecting a person to the line.

12. An elongate lighted lifeline comprising an elongate flexible wire-formed light source capable of generating laterally radiating light having an elongate flexible translucent sheathing extending thereabout, an electrical power source operatively connected to said light source adapted to energize said light source, an elongate flexible covering extending about said light source, said covering comprising an elongate rope having an axially extending opening through which said light source extends, and constructed to permit light radiating from said light source to pass therethrough, and a first connector coupled to one end of the covering and a second connector coupled to the other end of the covering.

13. The lifeline of claim 12, wherein said rope comprises a braided rope.

14. The lifeline of claim 12, wherein said covering comprises an elongate flexible translucent tube having a central bore through which said light source and rope extends.

15. The lifeline of claim 12, wherein said light source comprises an electroluminescent light source and said electrical power source comprises a battery electrically connected through an inverter to said light source to provide alternating current to said light source.

16. The lifeline of claim 12, wherein said rope comprises an elongate flexible braided rope having light passages extending between braided strands in the rope to permit light to pass therethrough.

17. The lifeline of claim 12, wherein the light source comprises multiple elongate light source segments coupled together in end-to-end configuration with each light source segment having a visual characteristic different from the segment adjacent thereto.

18. The lifeline of claim 17, wherein the visual characteristic is color.

19. The lifeline of claim 17, wherein the light source segments comprise electroluminescent light source segments which are electrically connected in series to be energized by a single power source.

20. The lifeline of claim 12, which further comprises a third connector mounted on said line for sliding movement along the line intermediate the first and second connectors.

21. The lifeline of claim 20, wherein a connector comprises a snap lock connector adapted to permit connecting a person to the line.

22. The lifeline of claim 12, wherein said light source is capable of producing light throughout a major portion of the length of the lifeline.

23. The lifeline of claim 12, wherein said light source is capable of producing light in a substantially continuous line throughout a major portion of the length of the lifeline.

24. A lighted line comprising an elongate flexible wire-formed light source capable of generating laterally radiating light having an elongate flexible translucent sheathing extending thereabout, an electrical power source operatively connected to said light source adapted to energize said source, and an elongate flexible covering extending about said light source, said covering comprising an elongate tension-resisting member extending about said light source constructed to permit light radiating from said light source to pass therethrough, and an elongate flexible translucent tube having a central bore through which said tension-resisting member and light source extend.

25. The line of claim 24, wherein said light source comprises a bulbless lighted wire.

26. The line of claim 24, wherein said light source comprises an electroluminescent light source.

27. The line of claim 24, wherein said light source comprises an electroluminescent light source and said electrical power source comprises a battery electrically connected through an inverter to said light source to provide alternating current to said light source.

28. The line of claim 24, wherein the light source comprises multiple elongate light source segments coupled together in end-to-end configuration with each light source segment having a visual characteristic different from the segment adjacent thereto.

29. The line of claim 28, wherein said visual characteristic is color.

30. The line of claim 28, wherein the light source segments comprise electroluminescent light source segments which are electrically connected in series to be energized by a single power source.

31. The line of claim 24, which further comprises a first connector coupled to one end of the line and a second connector coupled to the other end of the line.

32. The line of claim 31, which further comprises a third connector mounted on said line for sliding movement along the line intermediate the first and second connectors.

33. The line of claim 31, wherein a connector comprises a snap lock connector adapted to permit connecting a person to the line.

* * * * *

UNITED STATES PATENT AND TRADEMARK OFFICE

CERTIFICATE OF CORRECTION

PATENT NO. : 6,742,909 B2
DATED : June 1, 2004
INVENTOR(S) : Ronald S. Conti and Linda L. Chasko It is certified that error appears in the above-identified patent and that said Letters Patent is hereby corrected as shown below:

Column 1,
Line 5, “application the” should read -- application claims the --.

Column 2,
Line 48, “problems” should read -- problems. --

Signed and Sealed this

Fourteenth Day of December, 2004

JON W. DUDAS
*Director of the United States Patent and Trademark Office*